US008579131B2

(12) United States Patent
Greter et al.

(10) Patent No.: US 8,579,131 B2
(45) Date of Patent: Nov. 12, 2013

(54) TEAT FOR MILK BOTTLES

(75) Inventors: Andy Greter, Steinhausen (CH); Rochus Stöckli, Buochs (CH)

(73) Assignee: Medela Holding AG, Baar (CH)

( * ) Notice: Subject to any disclaimer, the term of this patent is extended or adjusted under 35 U.S.C. 154(b) by 1012 days.

(21) Appl. No.: 12/276,046

(22) Filed: Nov. 21, 2008

(65) Prior Publication Data

US 2009/0139950 A1 Jun. 4, 2009

Related U.S. Application Data

(63) Continuation-in-part of application No. PCT/CH2007/000267, filed on May 25, 2007, and a continuation-in-part of application No. PCT/CH2006/000278, filed on May 26, 2006, and a continuation-in-part of application No. PCT/EP2007/052142, filed on Mar. 7, 2007.

(51) Int. Cl.
*A61J 9/00* (2006.01)

(52) U.S. Cl.
USPC ..... 215/11.5; 215/11.1; 215/11.4; 215/11.7; 215/11.2; 215/11.6; D24/196; 426/117; 606/236

(58) Field of Classification Search
USPC ..... 215/11.5, 11.1, 11.4, 11.7; D24/196
See application file for complete search history.

(56) References Cited

U.S. PATENT DOCUMENTS 2,709,434 A 5/1955 Pancoast
5,035,340 A 7/1991 Timmons
5,747,083 A * 5/1998 Raymond et al. ..... 426/117
6,161,710 A * 12/2000 Dieringer et al. ..... 215/11.4
6,176,380 B1 * 1/2001 Glories et al. ..... 215/11.1
6,588,613 B1 * 7/2003 Pechenik et al. ..... 215/11.1

(Continued)

FOREIGN PATENT DOCUMENTS

BE 381523 8/1931
DE 29718952 1/1998

(Continued)

OTHER PUBLICATIONS

International Search Report for PCT/CH2007/000267, completed Nov. 23, 2007.

(Continued)

*Primary Examiner* — Anthony Stashick
*Assistant Examiner* — Cynthia Collado
(74) *Attorney, Agent, or Firm* — McDonnell Boehnen Hulbert & Berghoff LLP

(57) ABSTRACT

The invention relates to a teat for feeding bottles, including a receiving head, produced from a dimensionally stable material, and a rubber-elastic suction element. An entry channel leads to the bottle interior and channels lead from there to the outer surface of the receiving head. The suction element, in an initial position, elastically and sealingly rests on at least one section of an outer surface of the receiving head. Milk ducts are located in the contact area between the suction element and the receiving head and communicate with the channels of the receiving head which lead towards the outlet channel in the mouthpiece so that, when a vacuum is produced in the mouthpiece, milk can flow from the feeding bottle through the milk ducts to the outlet channel, the suction element being returnable to its initial position and the flow of milk being interrupted when there is no vacuum.

18 Claims, 11 Drawing Sheets

(56) References Cited

U.S. PATENT DOCUMENTS

| | | | | |
|---|---|---|---|---|
| 7,204,380 | B2 * | 4/2007 | Webb et al. | 215/11.4 |
| 7,540,388 | B2 * | 6/2009 | Silver | 215/11.1 |
| 2004/0144744 | A1 | 7/2004 | Holley | |
| 2011/0017696 | A1 * | 1/2011 | Elad et al. | 215/11.1 |

FOREIGN PATENT DOCUMENTS

| | | |
|---|---|---|
| EP | 1416900 | 5/2004 |
| GB | 2370787 | 7/2002 |
| MX | 05004972 | 8/2005 |
| WO | 02/22073 | 3/2002 |
| WO | 03/013419 | 2/2003 |

OTHER PUBLICATIONS

International Search Report for PCT/CH2006/000278, completed Jan. 10, 2007.

International Search Report for PCT/EP2007/052142, completed Jun. 8, 2007.

* cited by examiner

TEAT FOR MILK BOTTLES

CROSS-REFERENCE TO RELATED APPLICATIONS:

This application is a continuation-in-part of International application No. PCT/CH2007/000267 filed May 25, 2007. This application is also a continuation-in-part of International application No. PCT/CH2006/000278 filed on May 26, 2006. This application is also a continuation-in-part of International application No. PCT/EP2007/052142 filed on Mar. 7, 2007. The entire contents of each of these applications are incorporated by reference herein.

TECHNICAL FIELD

The present invention relates to a teat for milk bottles, i.e. milk bottles for infants.

PRIOR ART

Breastfeeding is the best and most natural way to feed a baby. Many scientific studies have shown that breastmilk is of great importance in the development of the baby. The immune system is stronger, and the baby is more robust. The mechanical effect of sucking on the breast also has a significant influence on the development of the palate shape and of the muscles. Unfortunately, breastfeeding is not always possible, or in some cases it is possible only to a limited degree: for example if the mother returns to work or is absent when the baby wants to feed, in cases of disease, if the nipples are sore, or if the mother has too little milk and the baby additionally requires replacement feed.

In these situations, the milk is pumped off and given to the baby by bottle, spoon, beaker or finger. Unfortunately, the teats available today have negative effects on breastfeeding. The problems lie in the fact that the baby has to learn the technique of suckling at the breast. When it has become used to this and then has to drink from a bottle, it initially sucks from the latter in the same way as from the breast. The baby then notices that the teat behaves differently and that the ratio between vacuum and milk flow is different. Likewise, the peristaltic movement of the tongue cannot be performed to the same extent. In many conventional teats, the baby has to stop the flow of milk with its tongue instead of with the reduction in the vacuum.

Most teats are hollow on the inside and have holes or slits at the outlet. However, the diameters of the holes at the outlet are very rarely the optimum diameters: the passages are either too large or too small. Moreover, teats that are hollow on the inside do not have the correct elasticity. They are often too soft or too hard. Another weak point of the teats available today is that, during the sucking phase, practically no lengthening of the mouthpiece takes place.

A crucial factor during sucking is the interface between the baby's lips and the areola in terms of lip support. In conventional teats, the lips are not supported in a natural way because the teats, in the area of the lip support, do not participate in the function and because they are hollow and have too little elasticity.

It is true that teats with valves have been developed (see EP 1 416 900 B1, US 2004/144744, U.S. Pat. No. 5,035,340). There are also patents for teats with capillaries (see patent MXPA 05004972 or U.S. Pat. No. 6,588,613) which are intended to better simulate the natural function. Unfortunately, these systems have various disadvantages in use and are especially difficult to manufacture. Moreover, cleaning is difficult, which leads to disadvantages in terms of hygiene.

WO 03/013419 discloses a teat for a milk bottle with an inner part and outer part, wherein both parts are designed as flexible membranes that between them form a chamber. The inner part is provided with a valve, which controls the flow of milk from the bottle into the chamber. At its tip, the outer part has an opening through which the baby can suck the milk out of the chamber. The two parts are configured such that, when the outer part is pressed together or sucked, the valve is closed, and, when the outer part is released, the valve is opened.

WO 02/22073 discloses a two-part teat for a feeding cup, the inner part in this case acting as valve. In the rest state, the inner part is spring-loaded upward so as to press against the opening of the outer part, such that the teat is leaktight. If pressure is exerted, the inner part drops down and frees the opening of the outer part. If the outer part is now pressed together, it bears tightly on the side walls of the inner part, whereas in the released state it frees the through-channels to the cup.

BE 381523 describes a feeding bottle with a teat, and with a plate arranged between bottle and teat. This plate has capillaries in order to regulate the flow of milk.

GB 2 370 787 discloses a feeding bottle with a valve that is arranged in the teat and that is intended to regulate the flow of milk.

In the teats available today, the natural function of breastfeeding as a whole is not simulated. Individual aspects of the natural function are met by various suppliers, but there is as yet no product available that simulates all the aspects of breastfeeding to a satisfactory extent.

Because of the many weaknesses, a natural feeding action when drinking from the milk bottle is not really possible with the conventional teats. The baby is irritated by these shortcomings and becomes used to sucking the wrong way, which has a negative impact on the natural breastfeeding. Advisers on breastfeeding describe this as "nipple confusion".

DISCLOSURE OF THE INVENTION

It is therefore an object of the invention to make available a teat that simulates the sucking action on the human breast as closely as possible.

This object is achieved by a teat that has the features of the appended claims.

The teat according to the invention for breastmilk bottles has a receiving head made of a dimensionally stable material, and a suction body made of a rubber-elastic material. The receiving head is designed as the core of the teat, and the suction body can be pushed on over the receiving head. The receiving head is provided with an admission channel leading to the interior of the bottle, and with at least one channel leading from this to the outer surface of the receiving head. The suction body has a mouthpiece and, extending within the latter, an outlet channel for milk, such that, when an underpressure is generated in the mouthpiece, milk can flow from the milk bottle into the outlet channel. The suction body, in an initial position, bears elastically and sealingly with an inner surface on at least one portion of an outer surface of the receiving head. In this contact area between the suction body and the receiving head, milk channels are present which communicate with the at least one channel of the receiving head and lead toward the outlet channel in the mouthpiece such that, when an underpressure is generated in the mouthpiece, milk can flow from the milk bottle through the milk channels into the outlet channel, the suction body being able to return to its initial position and the flow of milk being interrupted when there is no underpressure.

The milk channels are preferably arranged in the inner surface of the suction body and/or in the outer surface of the receiving head, and they are in each case open toward the other surface.

The milk channels are preferably designed as capillaries. Capillaries are understood as narrow channels in which surface forces are active such that, without a vacuum being generated, there is no flow of milk.

In another embodiment of the invention, the teat for milk bottles has a receiving head made of a dimensionally stable material, and a suction body made of a rubber-elastic material, wherein the receiving head is designed as the core of the teat, and the suction body can be pushed on over the receiving head, wherein the suction body has a mouthpiece and, extending within the latter, an outlet channel for milk, such that, when an underpressure is generated in the mouthpiece, milk can flow from the milk bottle into the outlet channel, wherein the suction body, in an initial position, bears elastically and sealingly with an inner surface on at least one portion of an outer surface of the receiving head. This teat is characterized by capillary milk channels which are present in this contact area between the suction body and the receiving head and which lead toward the outlet channel in the mouthpiece such that, when an underpressure is generated in the mouthpiece, milk can flow from the milk bottle through the milk channels into the outlet channel, the suction body being able to return to its initial position and the flow of milk being interrupted when there is no underpressure.

In another embodiment of the invention, the teat for milk bottles has a receiving head made of a dimensionally stable material, and a suction body made of a rubber-elastic material, wherein the receiving head is designed as the core of the teat, and the suction body can be pushed on over the receiving head, wherein the suction body has a mouthpiece and, extending within the latter, an outlet channel for milk, such that, when an underpressure is generated in the mouthpiece, milk can flow from the milk bottle into the outlet channel, wherein the suction body, in an initial position, bears elastically and sealingly with an inner surface on at least one portion of an outer surface of the receiving head, and wherein an admission channel leading to the interior of the bottle is provided in the receiving head. This teat is characterized by at least one channel which is provided in the receiving head and which leads from the admission channel to the outer surface of the receiving head in the contact area of the suction body, such that, when an underpressure is generated in the mouthpiece, milk can flow from the milk bottle through the milk channels into the outlet channel, the suction body being able to return to its initial position and the flow of milk being interrupted when there is no underpressure.

The function is essentially the same as in normal breastfeeding from the human breast. By means of the baby sucking on the teat, or on the tip thereof, a vacuum is generated and milk is conveyed out of the bottle, between the outer surface of the receiving head and the inner wall of the suction body, through to the outlet.

The natural sucking action consists basically of the following functions and parameters: sucking strength, sucking rhythm, tongue movement, support of the lips, and pressure on the nipple and areola. The teat according to the invention now provides an overall system which simulates all the main functions and parameters of breastfeeding. For example, if no vacuum or pressure is generated by the baby (by means of the lips or tongue), no milk is released. If the teat is pressed together, without a vacuum being generated, again there is no release of milk. Only when a vacuum and pressure on the teat are generated does the milk flow. The quantity of milk can thus be controlled by the vacuum, the suction rhythm and the pressure of the tongue and lips.

The teat feels soft and flexible. It is preferably made of an elastic solid material that extends in the longitudinal direction under vacuum, similarly to the nipple. The lip support is adaptable and elastic.

By virtue of the teat according to the invention, the vacuum/milk flow ratio is comparable to the milk flow of the human breast.

The teat according to the invention is also inexpensive to produce and can be optimally cleaned.

By means of the sucking on the mouthpiece and the peristaltic movement of the tongue, a vacuum is generated. As the vacuum builds up, and as a result of the tongue movement, the mouthpiece is deformed and axially lengthened. In addition, the lip support is deformed, such that the teat in the baby's mouth is sucked in far in the direction of the palate. By means of this movement, the suction body in the area of the milk channel closure wall lifts from the receiving head and opens the passage to the outlet channel. The milk thus flows out of the bottle through any milk channels and any milk chambers to the outlet channel. The milk channels lie between the outer surface of the receiving head and the inner wall of the suction body. The purpose of the milk channels is to allow the milk to be dispensed from the bottle in doses according to the sucking action of the baby. The milk flow in relation to the vacuum is determined by the capillary cross sections and capillary lengths. The milk chambers allow the mother in particular to visually check that there is no air in the system, since care should be taken to ensure that the baby does not swallow any air while drinking. The milk chambers are thus optional.

In a preferred embodiment, the actual suction body is composed of a soft elastic outer part of silicone and a harder inner part of silicone, which parts are preferably produced in a multi-component injection molding technique and are connected to each other in a non-detachable manner. The outer soft part of the suction body can preferably feel like, and deform in the same way as, the nipple and the areola. The inner harder part of the two-component silicone suction body gives the suction body the required stability. In addition to this stabilizing function, the inner part of the suction body also provides protection against the latter possibly being bitten through in the area of the elastic mouthpiece. The inner part is designed as a cylindrical tube in the area of the mouthpiece. Protection against biting through can also be provided by other geometric shapes or materials, for example a spiral or a fabric insert.

As has already been mentioned, the flow speed depends on the vacuum. At a low vacuum, there is minimal flow of milk, while at a higher vacuum the flow is correspondingly greater. Regardless of which vacuum suction curve the baby defines, the system adapts. Thus, for example, a baby may keep the vacuum at a high level over a long time and the milk flows constantly. As soon as the vacuum is reduced, the flow of milk also reduces. If no vacuum is applied to the teat between the sucking phases, the suction body bears on the milk channel closure wall and closes the outlet. The teat system thus adapts in each phase to the sucking action of the baby, regardless of how long the baby maintains the vacuum. The milk is released in accordance with the sucking action.

With the present invention, natural breastfeeding can be further enhanced since the baby is not confused by the teat and there is therefore no longer a danger of the breastfeeding being ended too early.

Particularly advantageous embodiments of the invention are set forth in the dependent claims.

BRIEF DESCRIPTION OF THE DRAWINGS

The invention is explained in more detail below with reference to the illustrative embodiments depicted in the drawings, in which.

WAYS OF IMPLEMENTING THE INVENTION

The invention described below relates to a teat for milk bottles or a drinking system for feeding infants.

Figure 1A:
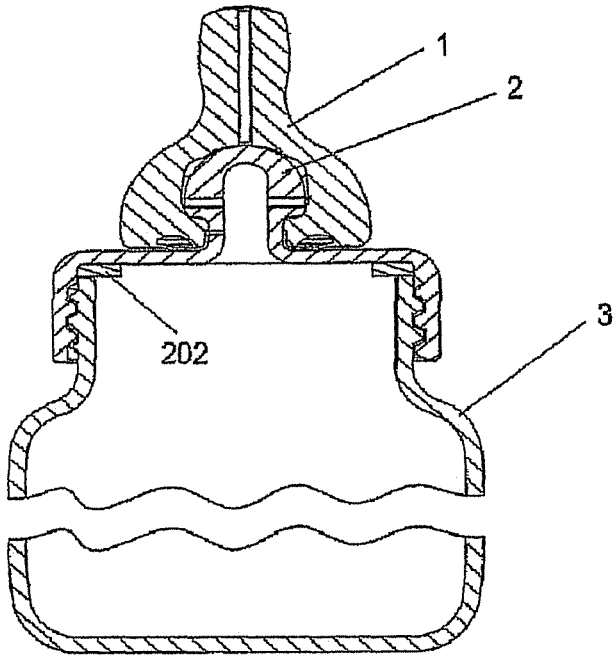
FIG. 1A shows the basic structure of a teat according to the invention fitted on a milk bottle, in a purely schematic cross section and according to a first embodiment.
Figure 2A:
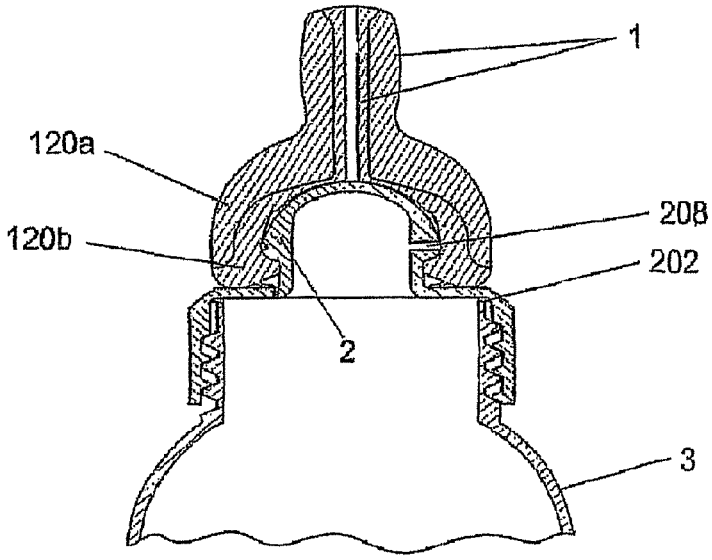
FIGS. 2A and 2B show a view of a second embodiment of teat and receiving head, respectively.

As is shown schematically in FIGS. 1A and 2A, the system is composed of a suction body 1 made of rubber-elastic material, e.g. of silicone, and a dimensionally stable or dimensionally rigid distributor head or receiving head 2 which forms a receiver for the suction body 1 and which is here provided with an integrated threaded flange or threaded ring 203 for screwing the receiving head 2 onto a milk bottle 3 in a detachable manner. The receiving head 2 is preferably made from a rigid plastic in an injection molding technique. For example, it is made from hard plastic.

The parts 1, 2, 2' described above form the teat according to the invention. A sealing ring 202 lying between teat and bottle 3 can be integrated as a separate part into the receiving head 2 or can be designed separately. It can in particular be designed as a multi-component injection molding part.

The suction body 1 preferably has an outer shape corresponding to the known teats and simulating the nipple of a human breast. It has a teat, here in the form of a tubular mouthpiece 117 with a milk outlet 123, which mouthpiece 117 widens toward a lip support 119 (see FIG. 4). The teat can be designed eccentrically.

The suction body 1 is preferably designed with a thick wall, i.e. it is substantially not hollow, except for a recess that is to be pushed on over the receiving head 2. The recess is dimensioned such that the suction body 1 in the rest state, i.e. without external underpressure, bears sealingly on the receiving head 2. From said recess, a milk outlet channel 106 leads to the milk outlet 123 at the outer tip of the suction body 1.

The suction body 1 can be designed in one piece, as is shown in FIG. 1A. However, it can also be designed in several pieces, in particular in two parts, as is shown in FIG. 2A. Here, the suction body 1 is composed of an outer part 120*a* and an inner part 120*b*. The inner part 120*b* and the outer part 120*a* are connected to each other in a non-detachable manner. The suction body 1 is preferably produced in a multi-component injection molding technique. The suction body 1 can also be produced from more than two materials or from only one material.

The outer part 120*a* of the suction body is made of a soft material. The mouthpiece 117 and lip support 119 in particular should correspond as far as possible to the shape and firmness of a nipple. The outer part 120*a* of the suction body 1, in the transition area between the lip support 119 and the mouthpiece 117, preferably has a thicker wall than the mouthpiece 117, such that this sensitive and fragile area is strengthened.

Figure 1B:
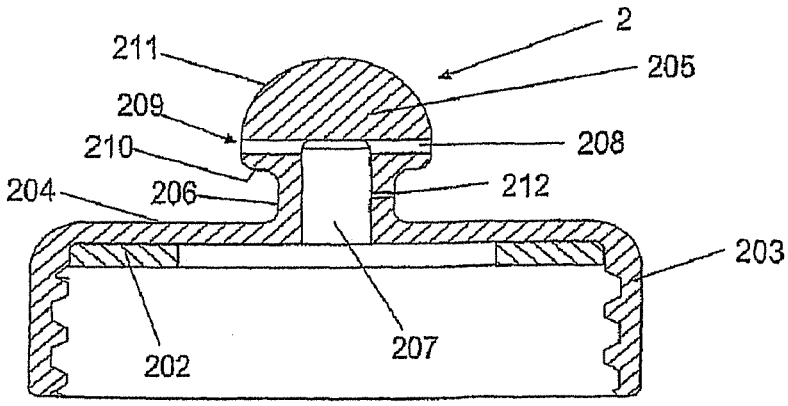
FIG. 1B shows, likewise in cross section, the receiving head (suction body receiver) with integrated threaded flange according to FIG. 1A.
Figure 2B:
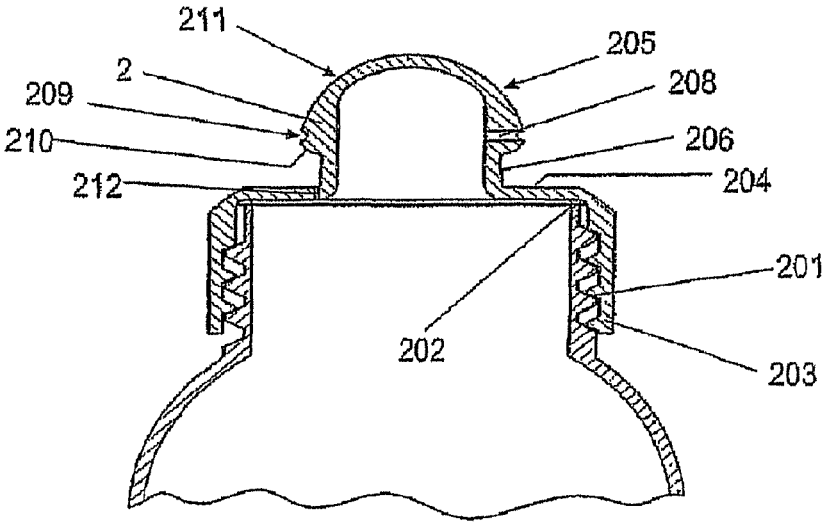
Figure 3A:
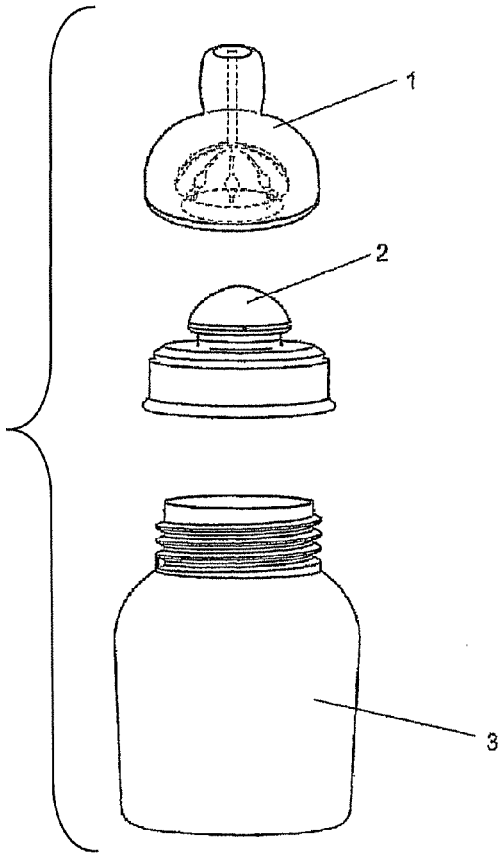
FIG. 3A shows an exploded view of a third embodiment of the teat according to the invention together with bottle.
Figure 3B:
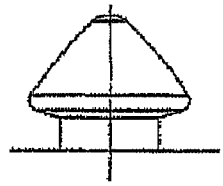
FIGS. 3B to 3D show, purely schematically, variants of a receiving head part according to FIG. 3A.
Figure 3C:
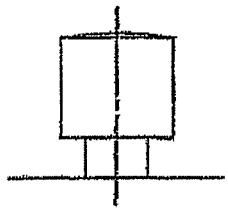
Figure 3D:
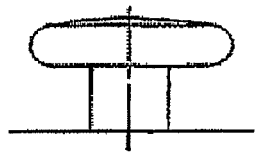

FIGS. 1B and 2B show the distributor head or receiving head 2. The head 2 is used to receive and position the suction body 1 and to transfer milk into the suction body 1. It has substantially the shape of a screw-on cap for a bottle, having a threaded collar 203 with inner thread 201, and a distributor head or head part 205 formed integrally on the cap. The cap has a cover surface or support surface 204 closing the threaded ring or threaded collar 203. Extending upward from this support surface 204 are a neck or a cylindrical part 206, and the abovementioned head part 205, which here has a substantially spherical shape.

Its outer wall or outer surface is indicated by reference number 211. In this example, it serves as a milk channel closure wall. The transition from the neck 206 to the head part 205 forms a sealing surface 210. The neck itself, with its cylinder wall, can also form a cylinder seal.

As is shown in FIGS. 3A to 3D, the receiving head part 205 preferably has the shape of a rotation body, in particular the shape of a sphere, a flattened sphere, a cone, a droplet, a cylinder, or a combination of these shapes. Other shapes are possible.

In the receiving head 2, there is a connection channel or admission channel 207, which leads to the interior of the bottle and which, via at least one distributor channel or connection channel 208, leads to the outer surface of the receiving head 2, at least one opening or channel being present.

A large number of connection channels 208 and therefore outlets can be provided. The connection channels 208 preferably open into at least one distributor outlet or distributor channel 209, which is preferably designed as an annular channel on the outer surface of the receiving head part 205. The distributor channel 209 preferably extends at a constant height around the head part 205. It is also possible, however, for several channels to be arranged above one another.

Figure 4:
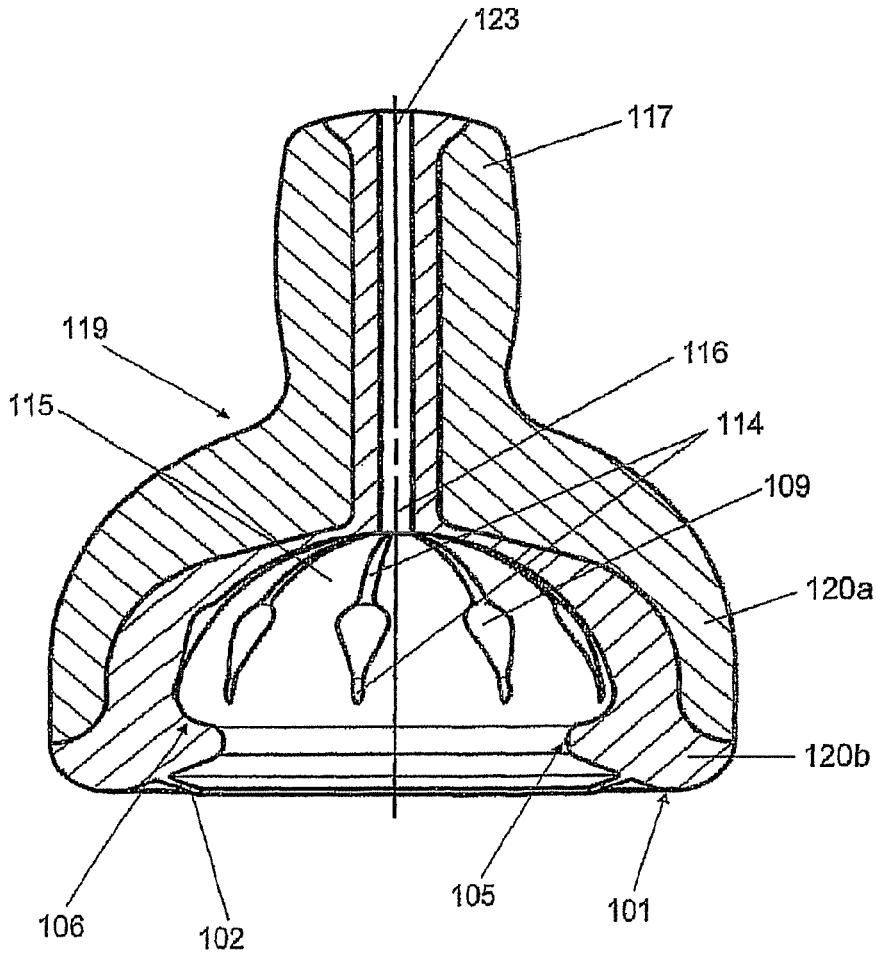
FIG. 4 shows the suction body according to FIG. 2A in cross section.

A vent hole 212 connects the interior of the bottle to the vent valve 102, which is shown in FIG. 4. This can be done, for example, via an admission channel 207 of the receiving head 2, or directly.

The suction body 1, in FIG. 2A the rubber-elastic inner part 120*b*, is pushed on over the receiving head part 205. In the state when thus fitted, the suction body 1, as shown in FIGS. 1A and 2A, now bears against the support surface 204, the cylindrical part 206 and the outer surface or wall 211 of the receiving head part 205. It is at these surfaces that the suction body 1 is sealed and fixed. The recess of the suction body 1, or its inner wall, defines a sealing surface 115, which is shown in particular in FIG. 4. This sealing surface 115 is substantially spherical, or adapted to the shape of the receiving head part 205, and narrows downward in the direction of the bottle neck. It merges into a holding surface 106, which extends approximately perpendicular to the longitudinal axis of the suction body 1 in the form of a parapet, and this is followed by a narrowing in the form of a cylindrical neck, which forms a cylinder seal 105. The recess then widens again and extends obliquely outward in cross section. Said vent valve 102 is arranged in the form of a circumferential lip in this area.

The underside of the suction body 1 preferably has a flattened shape and forms a bearing surface 101. The supporting and positioning with respect to the receiving head 2 or the teat receiver are effected via this bearing surface 101, the cylinder seal 105 and the holding surface 106.

The milk flows out of the bottle 3 to the suction body 1 by way of the connection channel 208. Capillary milk channels 114 (described below) of the teat communicate with the distributor channel 209. As is shown below, the milk channels 114 open to the inside, and any milk chambers 109 provided, are closed by the outer wall or outer surface 211 of the receiving head part 205.

Figure 5A:
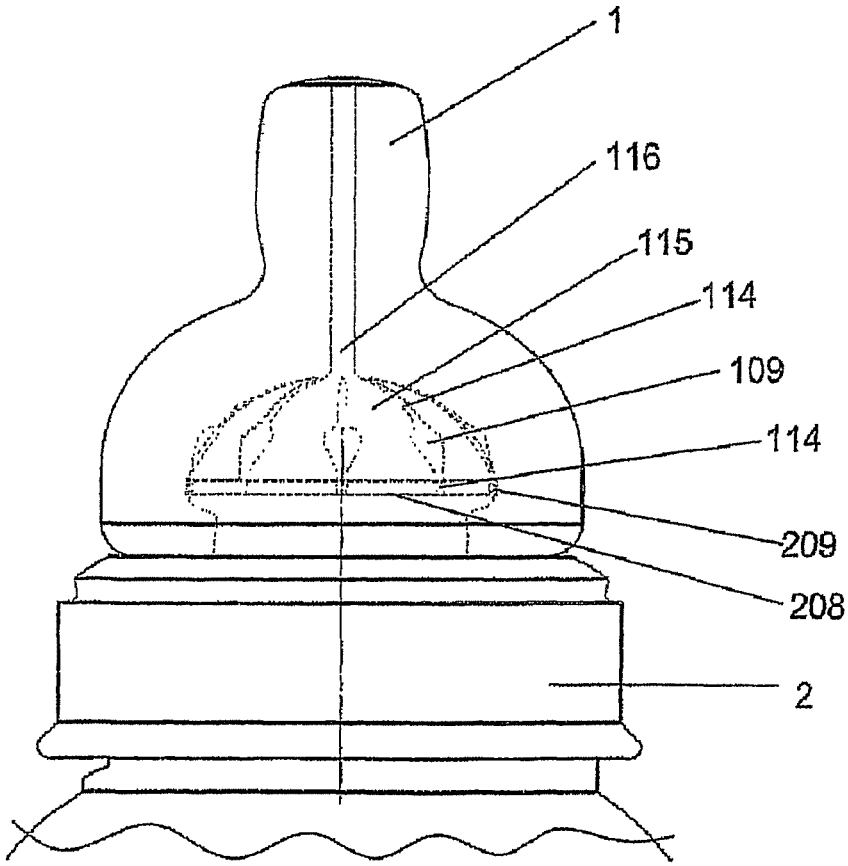
FIG. 5A shows the teat according to FIG. 3A in the assembled state.
Figure 5B:
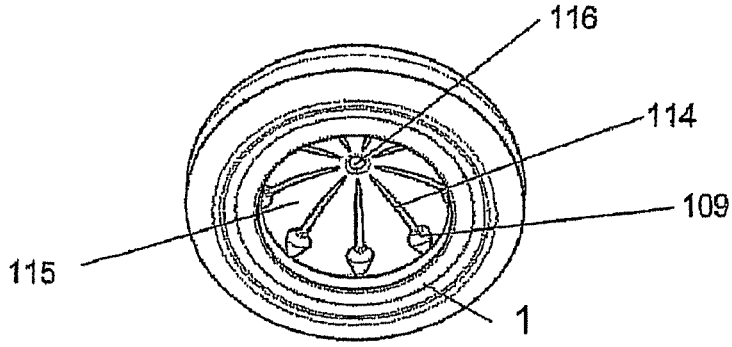
FIG. 5B shows the suction body according to FIG. 3A in a perspective view from underneath.
Figure 5C:
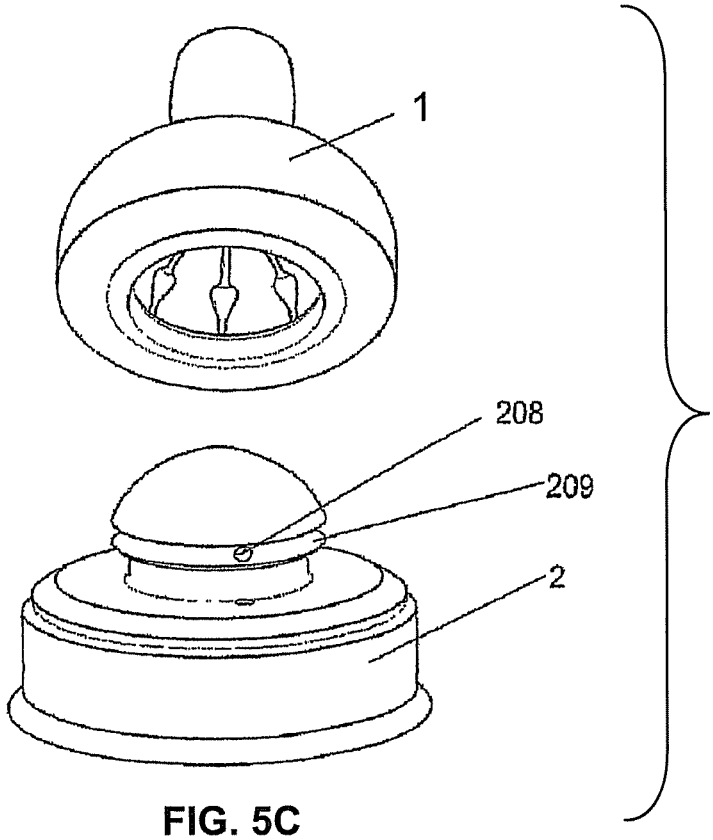
FIG. 5C shows an exploded view of suction body and receiving head according to FIG. 3A, with a view of the suction body from underneath.
Figure 6A:
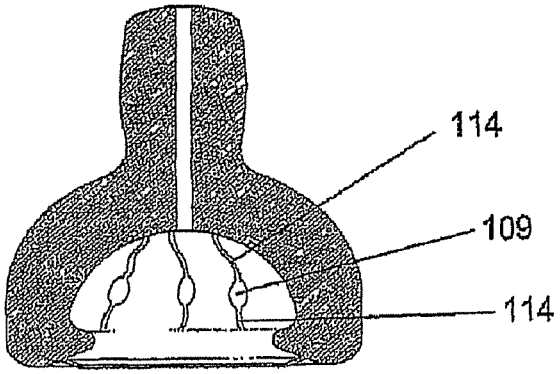
FIGS. 6A to 6D show a longitudinal section through a suction body according to the invention in further embodiments.
Figure 6B:
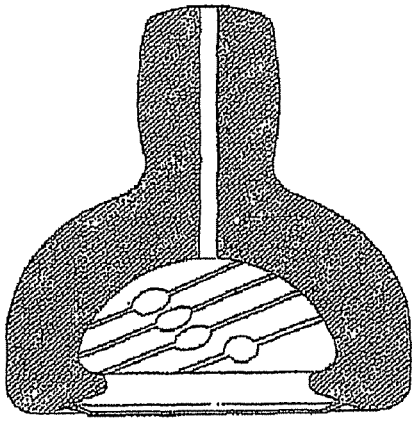
Figure 6C:
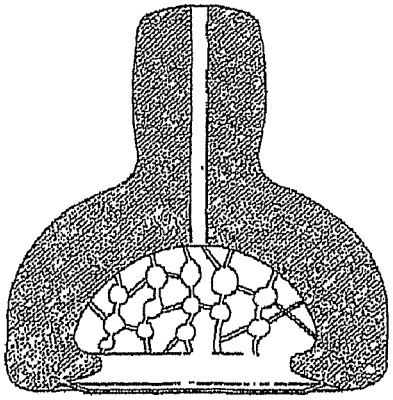
Figure 6D:
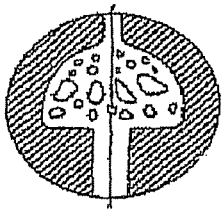

These milk channels 114 and milk chambers 109 are described in more detail with reference to FIGS. 4 and 5A. In the illustrative embodiment described here, they are integrated in the inner wall, or sealing surface 115, of the suction body. However, they could also be arranged completely or partially in the outer wall of the receiving head 2, in particular of the head part 205. The receiving head 2 and/or suction body 1 can also be formed without milk channels 114 or capillaries and be used only as a pure valve function in connection with a vacuum.

The milk channels 114 and milk chambers 109 are preferably distributed uniformly about the circumference of the recess of the suction body 1. They preferably extend along the dome-shaped recess or inner face 115 from a lower area, which in the mounted state extends preferably approximately to or completely to the annular channel 209 of the receiving head 2, to a milk collection channel or milk outlet channel 116, into which they preferably open, or in the area of which they end. The milk channels 115 preferably end above the annular channel 209 and below the outlet channel 116.

The milk chambers 109 can be arranged at the start of, at the end of, or at any desired location within, a milk channel 114. Each milk channel 114, or only some of them, can be provided with one or more milk chambers 109, or indeed none of them.

The channels 114 and milk chambers 109 can have different shapes. The chambers 109 preferably form pockets. For example, the channels 114 and the chambers 109 can be rectilinear, curved or thread-shaped, as is shown in FIGS. 5A, 5B, 5C and 6A to 6D. They can extend in isolation or be connected to one another via other channels. Likewise, some or all of the channels 114 can be integrated in the receiving head 2, particularly in the receiving head part 205, instead of in the suction body 1. The total cross-sectional surface area of all the milk channels 114 differs in size for use by infants of different ages.

The milk channels 114 and milk chambers 109 are open to one side in the longitudinal direction of the teat, i.e. they are only depressions or grooves in the suction body 1 and, without a mating piece, i.e. without the receiving head 2, they do not form closed channels. These openings are present for production reasons and are closed by the outer surface 211 of the receiving head part 205 acting as milk channel closure wall.

The milk channels 114 form capillaries through which milk flows under vacuum. The geometric shape, the width and the depth, combined with the correct Shore hardness of the rubber, permit natural sucking and milk flow as with the mother's breast.

The milk chambers 109 serve in particular as a means of visually checking that the milk flow is free of air.

The sealing surface 115 of the suction body 1 serves, on the one hand, to separate and seal off the milk channels 114 and milk chambers 109 from one another, and, on the other hand, as a closure between the admission channel 207, or milk supply channel, and the outlet channel 116. The outlet channel 116 collects the milk from the milk channels 114 and conveys it to the milk outlet 123. The outlet channel 116 here comprises at least one channel.

Figure 9A:
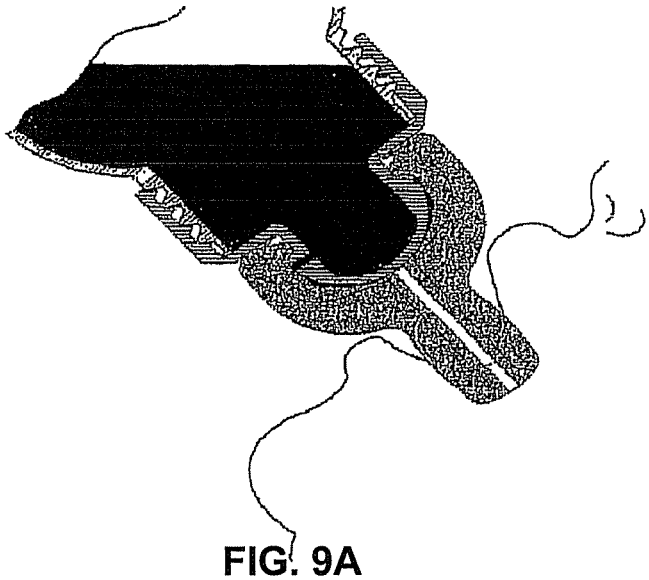
FIG. 9A shows a teat in the initial position (without vacuum)
Figure 9B:
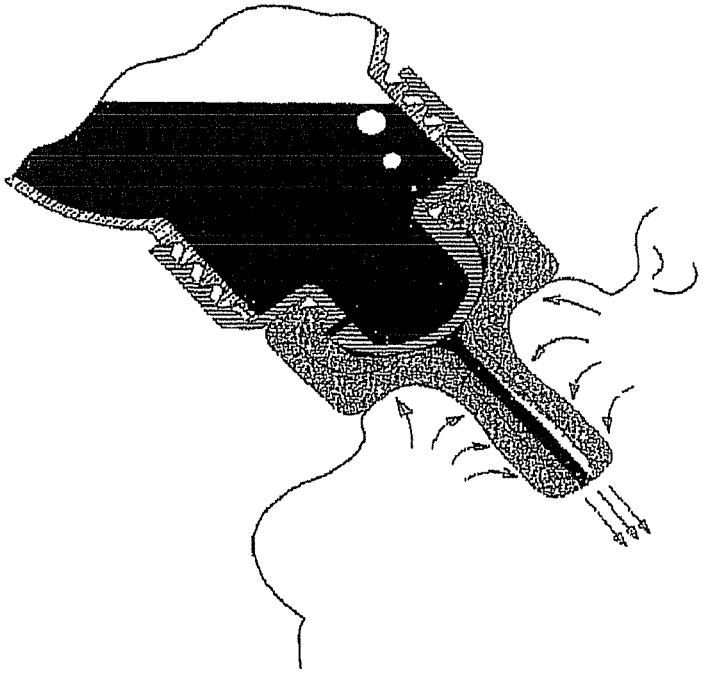
FIG. 9B shows a teat during the sucking phase.

As is shown in FIGS. 9A and 9B, the tip of the nipple is drawn into the mouth by the sucking function and is pressed together. The mouthpiece lengthens and, as a result of the deformation of the lip support 119, the mouthpiece reaches far into the baby's mouth. As a result of the axial movement of the mouthpiece 117, the sealing surface 115 of the suction body 1 lifts from the milk channel closure wall 211, i.e. the outer surface of the receiving head 2, and thus applies a vacuum to the milk channels 114. The greater the vacuum produced, the more the flow of milk is promoted. As soon as the baby reduces the vacuum, the teat moves back to the initial position and interrupts the flow of milk. FIG. 9 shows the closed milk passage or closed valve, when no vacuum is present and there is therefore no flow of milk. FIG. 9B shows the open milk passage or opened valve during the sucking phase.

Figure 7A:
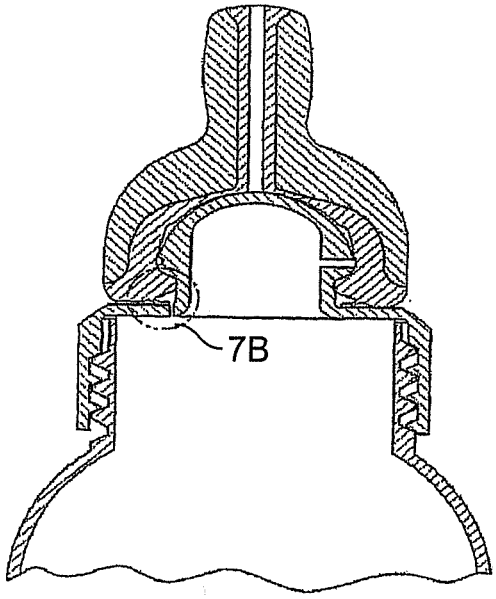
FIG. 7A to 7B shows a greatly enlarged detail, between suction body and receiving head, of the vent to the bottle interior.
Figure 7B:
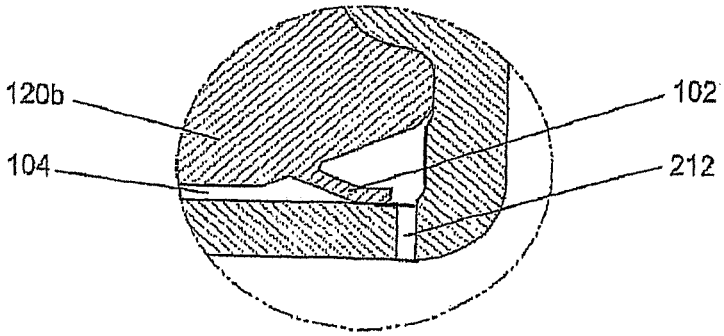

As can be seen in FIG. 7A to 7B, the interior of the bottle is vented by the vent sealing lip 102, which allows outside air to flow in when there is an underpressure in the bottle 3. The air flows through air admission opening 104 to the vent sealing lip 102. The vent sealing lip 102 allows the air to flow only in one direction. An opening between vent sealing lip 102 and vent hole 212 connects the interior of the bottle to the teat, such that an underpressure in the bottle allows air to flow into the bottle.

At a possible overpressure in the bottle 3, the vent sealing lip 102 is pressed onto the support surface 204 and prevents air or liquid from flowing out.

Figure 8:
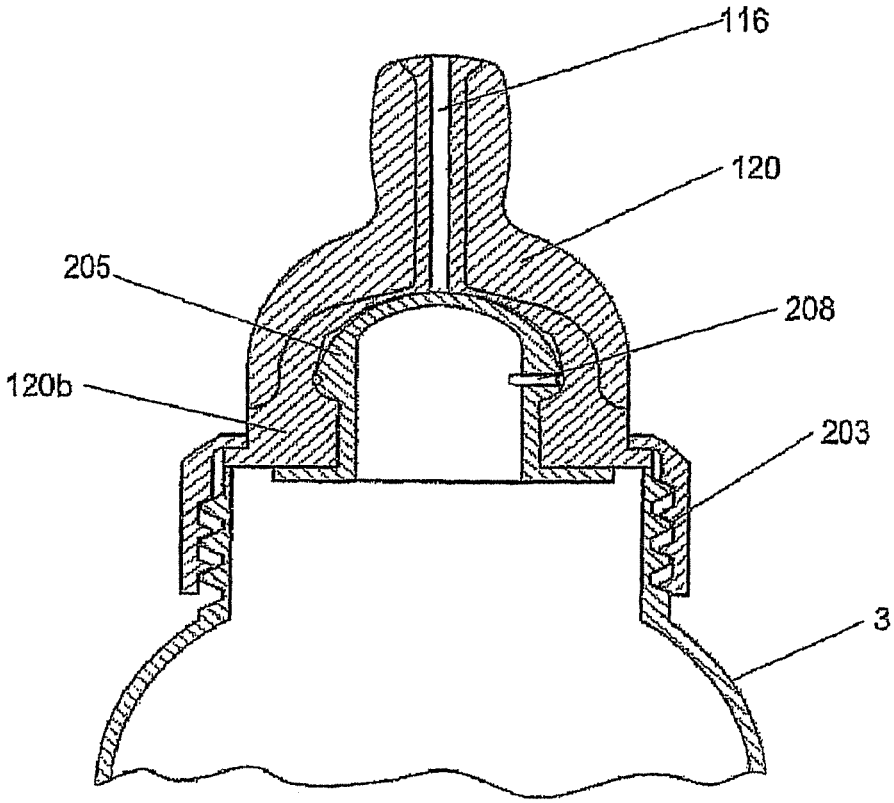
FIG. 8 shows a longitudinal section through the teat according to the invention in a further embodiment.

FIG. 8 shows a variant of the receiving head 2. Here, the receiving head part 205 and the threaded ring 203 are formed as two pieces. The threaded ring 203 corresponds more or less to the known threaded rings for feeding bottles. The suction body 1 is guided via this threaded ring 203 and is held by it on the bottle. The receiving head part 205 is pushed into the recess of the suction body 1 and held therein with a form fit.

Figure 10:
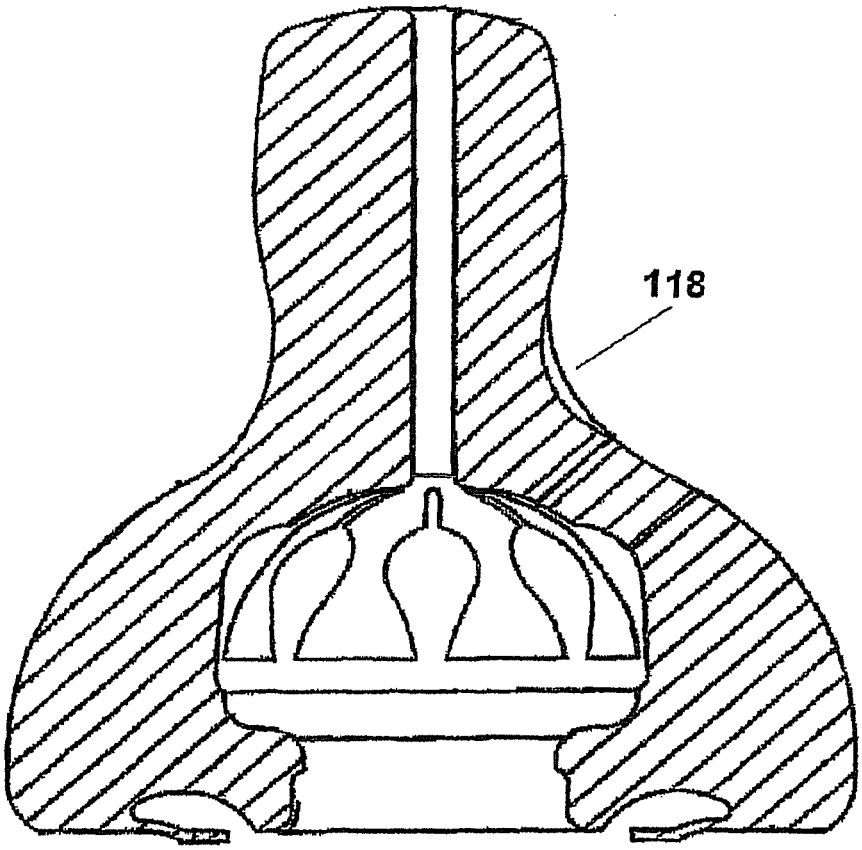
FIG. 10 shows a suction body according to the invention with a safety device according to a further embodiment.

In a preferred embodiment, as shown in FIG. 10, a safety device is also provided, which forms an important functional unit. It serves to avoid any defect that could cause injury to the baby. A defined weak point is built in which, after a certain degree of ageing, or after a certain period of use, is intended to tear, such that the mother is made aware of the defect before part of the teat comes loose and the baby has the chance to swallow this detached part or gets it stuck in his or her throat.

In this example, the safety device is composed of a predetermined tear area 118, which is arranged in the suction body 1 in the area of transition from the mouthpiece 117 to the lip support 119. This area is the part of the teat that is moved the most.

At this predetermined tear area 118, there is a defined wall thickness reduction on one side of the suction body 1, such that, after a certain degree of ageing, the teat does not tear entirely, but instead a leak occurs only on one side. In combination with this, the teat can be weakened on one side by eccentric or offset arrangement of the outlet channel 116. In this way, the predetermined tear area 118 is further supported. It is thus possible to avoid part of the teat coming loose and being swallowed. Instead, the teat starts to tear at a certain location or begins to leak.

This predetermined tear area 118 can also be used in other teats, in particular the conventional hollow teats.

The teat according to the invention permits a sucking action that is as natural as possible.

The invention claimed is:

1. A teat for milk bottles, wherein the teat has a receiving head made of a dimensionally stable material, and a suction body made of a rubber-elastic material, wherein the receiving head is designed as a core of the teat, and the suction body can be pushed on over the receiving head, wherein the suction body has main body with a recess and the suction body has a mouthpiece with a milk outlet, and wherein the suction body further includes an outlet channel for milk extending within the mouthpiece from the recess to the milk outlet, wherein the recess has an inner surface, wherein the recess is pushed on over the receiving head, wherein the recess is dimensioned such that the inner surface bears in an initial position, which is a rest position without external pressure applied elastically and sealingly on at least one portion of an outer surface of the receiving head, defining a contact area, and wherein an admission channel leading to the interior of the bottle is provided in the receiving head, and wherein the receiving head is provided with at least one channel that leads from the admission channel to the outer surface of the receiving head, and wherein, in the contact area between the recess and the receiving head, capillary milk channels are present which communicate with the at least one channel of the receiving head and lead toward the outlet channel in the mouthpiece, wherein the outlet channel extends within the mouthpiece, and wherein the capillary milk channels are arranged such that, when an underpressure is generated in the mouthpiece, milk can flow from the milk bottle through the milk channels into the outlet channel and through the milk outlet out of the suction body, the suction body being able to return to the initial position thereby interrupting the flow of milk when there is no underpressure.

2. The teat as claimed in claim 1, wherein the milk channels are arranged in the inner surface of the suction body and/or in the outer surface of the receiving head, and wherein the milk channels are in each case open toward the other surface.

3. The teat as claimed in claim 1, wherein a threaded ring is provided for detachable connection of the receiving head and of the suction body to the milk bottle.

4. The teat as claimed in claim 1, wherein the suction body is designed in one piece or in several pieces.

5. The teat as claimed in claim 1, wherein the suction body is composed at least of an outer part made of soft material and an inner part made of harder material.

6. The teat as claimed in claim 5, wherein the suction body has a lip support which has a greater external diameter than the mouthpiece, and wherein the outer part of the suction body, in the area of transition of the lip support to the mouthpiece, has a greater wall thickness than the mouthpiece.

7. The teat as claimed in claim 1, wherein the receiving head has the shape of a rotation body, such as a sphere, a cone, a droplet, a cylinder, or a combination thereof.

8. The teat as claimed in claim 1, wherein the milk channels are rectilinear, curved or thread-shaped and extend either separately from one another or connected to one another.

9. The teat as claimed in claim 1, wherein the total cross-sectional surface area of all the milk channels differs in size for use by infants of different ages.

10. The teat as claimed in claim 1, wherein milk chambers with a widening cross section are arranged in the area of the milk channels.

11. The teat as claimed in claim 10, wherein the milk chambers are designed as pockets that are open toward the opposite surface.

12. The teat as claimed in claim 1, wherein a vent hole is provided in the receiving head, and a sealing lip that closes the vent hole is provided in the suction body, which sealing lip allows outside air to flow in when there is an underpressure in the bottle.

13. The teat as claimed in claim 1, wherein means that indicate a predetermined ageing are provided on the suction body.

14. A teat with a suction body, wherein the suction body has a predetermined tear area.

15. The teat as claimed in claim 14, wherein the predetermined tear area is arranged in a transition area between a mouthpiece, with an outlet channel, and a lip support that is wider compared to the mouthpiece.

16. A teat for milk bottles, wherein the teat has a receiving head made of a dimensionally stable material, and a suction body made of a rubber-elastic material, wherein the receiving head is designed as a core of the teat, and the suction body can be pushed on over the receiving head, wherein the suction body has a main body with a recess and the suction body has a mouthpiece with a milk outlet and, wherein the suction body further includes an outlet channel for milk extending within the mouthpiece from the recess to the milk outlet wherein the recess has an inner surface, wherein the recess is pushed on over the receiving head, wherein the recess is dimensioned such that the inner surface bears in an initial position, which is a rest position without external pressure applied, elastically and sealingly on at least one portion of an outer surface of the receiving head, defining a contact area, wherein capillary milk channels, present in the contact area between the recess and the receiving head, lead toward the outlet channel in the mouthpiece, wherein the outlet channel extends within the mouthpiece, and wherein the capillary milk channels are arranged such that, when an underpressure is generated in the mouthpiece, milk can flow from the milk bottle through the milk channels into the outlet channel and through the milk outlet out of the suction body, the suction body being able to return to the initial position thereby interrupting the flow of milk when there is no underpressure.

17. A teat for milk bottles, wherein the teat has a receiving head made of a dimensionally stable material, and a suction body made of a rubber-elastic material, wherein the receiving head is designed as a core of the teat, and the suction body can be pushed on over the receiving head, wherein the suction body has a main body with a recess and the suction body has a mouthpiece with a milk outlet and, wherein the suction body further includes an outlet channel for milk extending within the mouthpiece from the recess to the milk outlet wherein the recess has an inner surface, wherein the recess is pushed on over the receiving head, wherein the recess is dimensioned such that the inner surface bears in an initial position, which is a rest position without external pressure applied, elastically and sealingly on at least one portion of an outer surface of the receiving head, defining a contact area, and wherein an admission channel leading to the interior of the bottle is provided in the receiving head, wherein the receiving head is provided with at least one channel that leads from the admission channel to the outer surface of the receiving head in the contact area of the recess, such that, when an underpressure is generated in the mouthpiece, milk can flow from the milk bottle through the admission channel to the at least one channel that leads to the outer surface of the receiving head and further through capillary milk channels into the outlet channel and through the milk outlet out of the suction body, the suction body being able to return to the initial position thereby interrupting the flow of milk when there is no underpressure.

18. The teat as claimed in claim 5, wherein the outer part and the inner part are connected to each other in a non-detachable manner.

* * * * *